US008349092B2

(12) United States Patent
Specht et al.

(10) Patent No.: US 8,349,092 B2
(45) Date of Patent: Jan. 8, 2013

(54) PROCESS FOR COATING METALLIC SURFACES

(75) Inventors: Jürgen Specht, Rodgau (DE); Peter Schubach, Nidderau/Windecken (DE); Rüdiger Rein, Breidenbach (DE); Peter Claude, Bad Vilbel (DE)

(73) Assignee: Chemetall GmbH, Frankfurt (DE)

( * ) Notice: Subject to any disclaimer, the term of this patent is extended or adjusted under 35 U.S.C. 154(b) by 0 days.

(21) Appl. No.: 13/080,974

(22) Filed: Apr. 6, 2011

(65) Prior Publication Data

US 2011/0198000 A1 Aug. 18, 2011

Related U.S. Application Data

(63) Continuation of application No. 10/519,006, filed as application No. PCT/EP03/07359 on Jul. 9, 2003, now abandoned.

(30) Foreign Application Priority Data

Jul. 10, 2002 (DE) ..... 102 31 279
Aug. 9, 2002 (DE) ..... 102 36 526

(51) Int. Cl.
*C23C 22/12* (2006.01)
*C23C 22/07* (2006.01)

(52) U.S. Cl. ..... 148/253; 148/262; 106/14.12; 106/14.21

(58) Field of Classification Search ..... 148/253–263; 106/14.12, 14.21
See application file for complete search history.

(56) References Cited

U.S. PATENT DOCUMENTS

| | | | |
|---|---|---|---|
| 2,375,468 | A | 5/1945 | Clifford et al. |
| 3,619,300 | A | 11/1971 | Heller et al. |
| 3,676,224 | A | 7/1972 | Snee |
| 4,142,917 | A | 3/1979 | Yashiro et al. |
| 4,944,813 | A | 7/1990 | Hosemann et al. |
| 5,200,000 | A | 4/1993 | Yamamoto et al. |
| 5,207,840 | A | 5/1993 | Riesop et al. |
| 5,211,769 | A | 5/1993 | Sobata et al. |
| 5,258,079 | A | 11/1993 | Nakatsukasa et al. |
| 5,308,413 | A | 5/1994 | Sobata et al. |
| 5,415,701 | A | 5/1995 | Nittel et al. |
| 6,168,674 | B1 | 1/2001 | Gehmecker et al. |
| 6,261,384 | B1 | 7/2001 | Kolberg et al. |
| 6,379,474 | B1 | 4/2002 | Mayer et al. |
| 6,447,662 | B1 | 9/2002 | Brouwer et al. |
| 6,497,771 | B1 | 12/2002 | Schubach et al. |
| 6,530,999 | B2 | 3/2003 | Meagher et al. |
| 2004/0065389 | A1 | 4/2004 | Kolberg et al. |
| 2004/0129346 | A1 | 7/2004 | Kolberg et al. |
| 2006/0237099 | A1 | 10/2006 | Schneider |
| 2007/0119520 | A1 | 5/2007 | Busch et al. |

FOREIGN PATENT DOCUMENTS

| | | | |
|---|---|---|---|
| DE | 977 633 | C | 11/1967 |
| DE | 27 39 006 | A1 | 4/1978 |
| DE | 38 00 835 | A1 | 7/1989 |
| DE | 199 58 192 | A1 | 6/2001 |
| DE | 100 26 850 | A1 | 12/2001 |
| DE | 101 10 834 | A1 | 10/2002 |
| DE | 101 18 552 | A1 | 10/2002 |
| DE | 101 55 976 | A1 | 5/2003 |
| DE | 103 20 313 | A1 | 12/2004 |
| EP | 0 045 110 | A1 | 2/1982 |
| EP | 0 141 341 | A1 | 5/1985 |
| EP | 0 381 190 | A1 | 8/1990 |
| EP | 0 434 358 | A2 | 6/1991 |
| EP | 0 452 638 | A1 | 10/1991 |
| EP | 0 454 361 | A2 | 10/1991 |
| EP | 0 613 964 | A1 | 9/1994 |
| EP | 0 922 123 | B1 | 7/2000 |
| GB | 2 080 835 | A | 2/1982 |
| GB | 2 148 950 | A | 6/1985 |
| WO | WO 90/15889 | A1 | 12/1990 |
| WO | WO 96/01914 | | 1/1996 |
| WO | WO 99/07916 | A | 2/1999 |
| WO | WO 02/070781 | A | 9/2002 |

OTHER PUBLICATIONS

Donofrio J. "Zinc Phosonating" in Metal Finishing, Elsevier Science Publ., New York, 5 (1999), pp. 71-86.

*Primary Examiner* — Lois Zheng
(74) *Attorney, Agent, or Firm* — Fulbright & Jaworski LLP

(57) ABSTRACT

A method for treating or pre-treating parts, profiled-pieces, strips, sheet metals or wires having metallic surfaces, in which at least 5% of these surfaces consists of aluminum or of at least one aluminum alloy with an acid aqueous solution which contains fluoride, zinc and phosphate and which has the following dissolved contents in the phosphatizing solution: sodium virtually none, from 0.04 to less than 2 g/L; potassium virtually none or in a concentration ranging from 0.025 to 2.5 g/L; sodium and potassium in a concentration ranging from 0.025 to 2.5 g/L as sodium, whereby the potassium content is converted to sodium on a molar basis; zinc 0.2 to 4 g/L zinc, 5 to 65 g/L calculated as $PO_4$; 0.03 to 0.5 g/L phosphate free fluoride wherein the total fluoride is present in a concentration ranging from 0.1 to 5 g/L. A zinc-containing phosphate layer is thereby deposited onto the metallic surfaces with a layer weight ranging from 0.5 to 10 g/m$^2$.

24 Claims, No Drawings

PROCESS FOR COATING METALLIC SURFACES

This application is a continuation of U.S. Ser. No. 10/519,006 filed May 6, 2005 now abandoned, hereby incorporated by reference in its entirety, which is a Section 371 of PCT/EP03/07359 filed Jul. 9, 2003, and claims priority from German Patent applications 102 31 279.6 filed Jul. 10, 2002 and 102 36 526.1 filed Aug. 9, 2002.

The present invention relates to a process for the coating of metallic surfaces by zinc phosphating, and to the use of the substrates coated by the process according to the invention.

The coating of metallic surfaces with phosphate films can take place in many different ways. Phosphating solutions containing zinc, manganese and/or nickel ions are often used in the process. Some of the metallic substrates to be surface-coated in the baths or plants also have a proportion of aluminium or aluminium alloys, which may lead to problems. The phosphate film(s), together with at least one coat of paint, or paint-like coating applied subsequently, is generally intended to exhibit good corrosion protection and good paint adhesion. The simultaneous phosphating of substrates with different metallic surfaces has gained increasing importance. In particular, the proportion of aluminium-containing surfaces in these systems is growing, so that problems occur more readily and more frequently than in the past during phosphating in these systems.

For a major proportion of aluminium-containing metallic surfaces that come into contact with the phosphating solution, a relatively high proportion of Al is dissolved. During this process, in the presence of alkali metal ions and fluoride ions, on the one hand the precipitation of alkali- and fluoride-containing compounds, such as cryolite, usually occurs if a sufficient content of alkali metal and/or fluoride ions is present, and on the other hand an increased content of dissolved aluminium can prove to be a bath poison, which seriously impedes the formation of the phosphate film so that a thin, undefined, possibly barely crystalline phosphate film is then formed with relatively poor corrosion resistance and low paint adhesion.

With fluoride ions in excess, an Al—F complex can form, which is dissolved in the solution but which can also lead to a precipitate with monovalent ions, such as e.g. sodium and/or potassium. The precipitate can accumulate as sludge in the bath vessel and be removed from there, but can also cause problematic deposits on the aluminium-containing metallic surfaces.

Until now, the influences leading to poor formation of the phosphate film on the one hand or to the depositing of precipitates, e.g. based on cryolite, and to defects in the subsequent paint film, were little known. The chemical conditions under which the problems occur were unclear, as they did not always occur and were unpredictable. How these problems could be countered was also unknown. It was known to increase the content of free fluoride more markedly in the event of a problem but in this case, serious problems have sometimes also occurred with cryolite-containing precipitates.

EP-A1-0 452 638 teaches a process for the phosphating of surfaces of steel, galvanised steel together with aluminium-containing surface portions with a phosphating solution having a total content of sodium ions in the range of at least 2 g/l, a content of sodium and potassium ions together of 2 to 15 g/l and a content of manganese ions of at least 1 g/l.

EP-A2-0 434 358 describes a process for the phosphating of metallic surfaces in the presence of aluminium, in which the phosphating solution contains, as well as zinc, at least one complex fluoride and a so-called simple fluoride, in which the molar ratio of complex fluoride to simple fluoride is in the range of 0.01 to 0.5. A dissociated and non-dissociated hydrofluoric acid is referred to here as simple fluoride. In this process, at least one separate treatment vessel or separate precipitating vessel is used. However, this publication mentions no concrete measures relating to monovalent cations which enable cryolite precipitates to be avoided except by using an additional separate vessel. The value of the free acid FA is said to be 0.5 to 2 points, but was determined without the addition of KCl and would correspond to about 0.3 to 1.5 points FA-KCl. EP-A2-0 454 361 contains a very similar teaching.

DE-A1-100 26 850 protects a phosphating process in which the deposition of problematic cryolite precipitates in the area of the metallic surfaces to be coated is avoided by a limitation of the aluminium content of the phosphating solution and by using an additional, separate precipitating vessel, through which the phosphating solution has to circulate.

The object therefore existed of proposing a phosphating process for the coating of surfaces, including those containing aluminium, in which a separate precipitation area in the vessel for the phosphating solution or separate vessels for precipitation, and thus for avoiding precipitates on the metallic surfaces to be coated, are unnecessary. The phosphate film should be continuous, of a good, fine-particle crystallinity, of sufficiently high corrosion resistance and of sufficiently good paint adhesion. The process should be implementable as simply, reliably and inexpensively as possible.

The object is achieved by a process for the treatment or pre-treatment of parts, profiles, strips, sheets and/or wires with metallic surfaces, in which at least 5% of these surfaces consist of aluminium and/or at least one aluminium alloy and optionally the other metallic surfaces can consist in particular of iron alloys, zinc and/or zinc alloys, with an acidic, aqueous solution containing zinc, fluoride and phosphate, wherein the contents dissolved in the phosphating solution are as follows:

- sodium: virtually none or in the concentration range of 0.04 to less than 2 g/l,
- potassium: virtually none or in the concentration range of 0.025 to 2.5 g/l,
- sodium and potassium together: in the concentration range of 0.025 to 2.5 g/l as sodium, the potassium content being converted to sodium on a molar basis,
- zinc: in the concentration range of 0.2 to 4 g/l,
- phosphate: in the concentration range of 4 to 65 g/l, calculated as $PO_4$,
- free fluoride: in the concentration range of 0.03 to 0.5 g/l,
- total fluoride: in the concentration range of 0.1 to 5 g/l and
- optionally nitrate: at least 0.2 g/l, wherein a zinc-containing phosphate film is deposited on the metallic surfaces with a coating weight in the range of 0.5 to 10 $g/m^2$.

The term "virtually none" for the various contents is intended to indicate that minor impurities, contents dissolved out or carried over or, in individual cases, chemical reactions can lead to small contents.

The term "pre-treatment", in contrast to the term "treatment", is intended to indicate within the meaning of this application that at least one substantial coating, such as e.g. at least one coat of a paint and/or a paint-like material, is applied on to the pre-treatment coat.

At least 8% of these surfaces preferably consist of aluminium and/or at least one aluminium alloy, particularly preferably at least 12%, at least 18%, at least 24%, at least 30%, at least 40%, at least 50%, at least 60%, at least 75% or at least 90%.

For most types of ions, the dissolved contents can often be present in a non-complexed and a complexed state together at the same time.

The contents dissolved in the phosphating solution can preferably be as follows:

- sodium: in the concentration range of 0.08 to 1.8 g/l, or such that at least a very small quantity is added,
- potassium: in the concentration range of 0.05 to 2.2 g/l or such that at least a very small quantity is added,
- sodium and potassium together: in the concentration range of 0.05 to 2.5 g/l as sodium, potassium being converted to sodium on a molar basis,
- zinc: in the concentration range of 0.25 to 3.5 g/l,
- phosphate: in the concentration range of 5 to 50 g/l, calculated as $PO_4$,
- free fluoride: in the concentration range of 0.085 to 0.35 g/l and/or
- total fluoride: in the concentration range of 0.2 to 4 g/l.

The content of sodium and potassium together, calculated as sodium, is particularly preferably 0.08 to 2.2 g/l, especially preferably 0.2 to 2 g/l, particularly 0.3 to 1.8 g/l, especially up to 1.6 g/l. The content of zinc is particularly preferably 0.3 to 3 g/l, of phosphate 6 to 40 g/l, of free fluoride at least 0.08 g/l or up to 0.3 g/l and/or of total fluoride 0.3 to 3 g/l, particularly at least 0.4 g/l or up to 2.5 g/l total fluoride.

It is particularly advantageous if the content of sodium, potassium and optionally other alkali metal ions, of ammonium and nitrate ions is kept as low as possible, particularly if an addition of only up to 1 g/l or virtually none of each is used, preferably of optionally up to 0.5 g/l or of up to 0.2 g/l in each case, an addition of nitrate advantageously being kept to at least 0.4 g/l but no more than 6 g/l, particularly advantageously only up to 4 g/l, especially preferably only up to 3.5 or 3 or 2.5 or 2 g/l.

If the content of free fluoride in the phosphating solution is too high, an increased formation of cryolite and/or related compounds containing Al—F occurs, which can lead to paint defects in the subsequent paint film. Preferably, no bifluoride of sodium and/or potassium is added.

The content of dissolved, including complexed, zinc can be particularly 0.4 to 2.5 g/l, particularly preferably 0.5 to 2.2 g/l, with a content of 0.5 to 2.5 g/l and particularly 0.7 to 2.0 g/l being preferred for application of the phosphating solution by dip-coating and 0.3 to 2 g/l and particularly 0.5 to 1.5 g/l for spray application.

The phosphate content can be particularly 6 to 40 g/l $PO_4$, especially at least 8 g/l or up to 36 g/l.

The phosphate film applied with the phosphating solution according to claim 1 can be applied either directly on to a metallic surface, on to an activated metallic surface, e.g. by activation based on titanium phosphate, or on to at least one previously applied preliminary coating, such as e.g. on to a first phosphate film which is not used, or not exclusively used, for activation, and/or on to at least one coating with a different type of chemical composition, such as e.g. on to a coating containing complex fluoride, silane and/or polymers.

To assess whether problematic precipitation products have been deposited on a coated, Al-containing, metallic surface, a sample of the surface of an Al-containing surface is placed in a scanning electron microscope, optionally after breaking it down into a suitable sample format, and is examined there by means of energy-dispersive or wavelength-dispersive analysis for the presence of sodium or potassium, which are not generally incorporated into the crystal lattices of the zinc phosphates, as representatives of the other alkali or alkaline earth metals or ammonium, which can be precipitated together with the sodium and potassium. If areas under the scanning electron microscope allow sodium and/or potassium to be detected by EDX, particularly by crystalline precipitation products with cube-like crystals, a precipitation of a sodium- and/or potassium-containing substance, such as e.g. cryolite, is assumed.

In the process according to the invention, the contents of dissolved aluminium in the phosphating solution can preferably be within the concentration range of 0.002 to 1 g/l, particularly of at least 0.005 g/l, particularly preferably 0.008 to 0.7 g/l, especially 0.0.1 to 0.4 g/l. An aluminium content higher than 0.1 g/l is not harmful to the process according to the invention.

In the process according to the invention, the total content of silicon complex fluoride and boron complex fluoride together in the phosphating solution can preferably be 0.01 to 8 g/l—optionally converted to $SiF_6$ on a molar basis, it being unnecessary for both groups of fluoride complexes to occur at the same time. The sum of the contents of complex bound fluoride in silicon complex fluoride and boron complex fluoride is preferably 0.01 to 8 g/l, particularly preferably 0.02 to 5.3 g/l, especially preferably 0.02 to 4 g/l, in particular less than 3 or 2 g/l or even no more than 1.8 g/l. It is particularly preferred if the content of silicon complex fluoride does not exceed 1.8 g/l.

In the process according to the invention, the contents of complex bound fluoride in the phosphating solution can preferably be 0.01 to 8 g/l, calculated as $SiF_6$, converting on a molar basis.

In the process according to the invention, the contents dissolved in the phosphating solution can be as follows:

- sodium: 0.05 to 2 g/l,
- potassium: virtually none or 0.030 to 1.5 g/l,
- silicon complex fluoride: 0.01 to 4 g/l and/or
- boron complex fluoride: 0.01 to 4 g/l,
- the last of these calculated as $SiF_6$ and $BF_4$ respectively.

The contents of silicon complex fluoride are preferably 0.01 to 2.5 g/l and/or of boron complex fluoride preferably 0.01 to 2.8 g/l. In particular, contents of sodium in the range of 0.05 to 2 g/l, potassium virtually none or in the range of 0.05 to 1 g/l, silicon complex fluoride in the range of 0.03 to 3.2 g/l and/or boron complex fluoride in the range of 0.03 to 3.5 g/l, the last of these calculated as $SiF_6$ and $BF_4$ respectively, can be present here. Contents of sodium in the range of 0.05 to 2 g/l, potassium virtually none or in the range of 0.05 to 1 g/l, silicon complex fluoride in the range of 0.03 to 2.5 g/l and/or boron complex fluoride in the range of 0.03 to 2.8 g/l can especially be present here. This variant particularly preferably contains more sodium than potassium.

Alternatively in the process according to the invention, the contents dissolved in the phosphating solution can preferably be as follows:

- sodium: virtually none or 0.060 to 1.8 g/l,
- potassium: 0.035 to 1.4 g/l,
- sodium and potassium in the concentration range of 0.05 to 2 g/l as sodium, potassium being converted to sodium on a molar basis,
- silicon complex fluoride: 0.02 to 1 g/l and/or
- boron complex fluoride: 0.02 to 3 g/l,
- the last of these calculated as $SiF_6$ and $BF_4$ respectively.

The contents dissolved in the phosphating solution can be as follows: sodium 0.05 to 1.9 g/l, potassium 0.05 to 4 g/l, silicon complex fluoride 0.03 to 0.8 g/l and/or boron complex fluoride 0.03 to 2.5 g/l or 0.03 to 1.8 g/l, the last of these calculated as $SiF_6$ and $BF_4$ respectively. This variant particularly preferably contains more potassium than sodium. It is particularly preferred that the content of sodium and potassium together in the phosphating solution is in the concentration range of up to 1.8 g/l, especially preferably up to 1.5 g/l, in particular up to 1.1 g/l, quoted as sodium with potassium being converted to sodium on a molar basis.

In the process according to the invention, the dissolved contents in the phosphating solution can preferably be as follows:

nickel: virtually none or 0.001 to 3 g/l and/or manganese: virtually none or 0.002 to 5 g/l, particularly nickel: 0.02 to 2 g/l, particularly preferably 0.1 to 1.5 g/l and particularly manganese: 0.05 to 4 g/l, particularly preferably 0.1 to 3 g/l. The manganese content is especially preferably less than 1 g/l since this enables chemicals to be saved.

In the process according to the invention, the dissolved contents in the phosphating solution can preferably be as follows:

dissolved iron$^{2+}$ ions: virtually none or 0.005 to 3 g/l and/or complexed iron$^{3+}$ ions: virtually none or 0.005 to 1 g/l, particularly dissolved iron$^{2+}$ ions: 0.02 to 2 g/l, particularly preferably 0.1 to 1.5 g/l, and particularly complexed iron$^{3+}$ ions: 0.002 to 0.5 g/l, particularly preferably 0.005 to 0.1 g/l. These contents particularly occur in processes that run on the iron side, i.e. the phosphating solution, optionally together with the accelerator(s) present, has a composition such that it is able to keep dissolved $Fe^{2+}$ in solution in a somewhat increased content. The complexed iron$^{3+}$ ions are especially preferably present predominantly or exclusively as a fluoride complex or complexes.

In the process according to the invention, the dissolved contents in the phosphating solution can preferably be as follows:

silver: virtually none or 0.001 to 0.080 g/l and/or copper: virtually none or 0.001 to 0.050 g/l, particularly silver: 0.002 to 0.030 g/l, particularly preferably up to 0.015 g/l and particularly copper: 0.002 to 0.015 g/l, particularly preferably up to 0.010 g/l.

In the process according to the invention, the dissolved contents in the phosphating solution can preferably be as follows:

titanium: virtually none or 0.001 to 0.200 g/l and/or zirconium: virtually none or 0.001 to 0.200 g/l, particularly titanium: in the range of 0.002 to 0.150 g/l, particularly preferably in the range of up to 0.100 g/l and particularly zirconium: in the range of 0.002 to 0.150 g/l, particularly preferably in the range of up to 0.100 g/l. It is especially preferred if neither a titanium nor a zirconium compound is added to the phosphating solution. Moreover, it can be advantageous to avoid titanium-containing alloys as metallic surfaces to be phosphated.

In the coating process according to the invention, the phosphating solution can have the following contents:

zinc: in the range of 0.4 to 2.5 g/l, manganese: in the range of 0.3 to 2.0 g/l, weight ratio of zinc:manganese: in the range of 0.7:1 to 1.8:1, phosphate calculated as $PO_4$: in the range of 7 to 35 g/l, weight ratio of zinc:phosphate: in the range of 0.01 to 0.2, free fluoride content: 0.05 to 0.6 g/l and/or complex fluoride content: in the range of 0.1 to 4.5 g/l, as $SiF_6$.

In the coating process according to the invention, the phosphating solution can have the following contents:

zinc: in the range of 0.5 to 1.9 g/l, manganese: in the range of 0.4 to 0.95 g/l, weight ratio of zinc:manganese: in the range of 0.8:1 to 1.6:1, phosphate calculated as $PO_4$: in the range of 8 to 30 g/l, weight ratio of zinc:phosphate: in the range of 0.012 to 0.16, free fluoride content: 0.06 to 0.4 g/l and/or complex fluoride content: in the range of 0.2 to 4 g/l, as $SiF_6$.

However, it is particularly preferred for the zinc content in the phosphating solution to be greater than its manganese content.

In the process according to the invention, the dissolved contents in the phosphating solution can preferably be as follows:

ammonium: virtually none or 0.01 to 50 g/l and/or nitrate: virtually none or 0.01 to 30 g/l, particularly ammonium: 0.012 to 20 g/l, particularly preferably 0.015 to 5 g/l and particularly nitrate: 0.05 to 20 g/l, particularly preferably 0.1 to 12 g/l. Ammonium ions can be an alternative to other monovalent cations, but small or moderate contents of ammonium ions do not generally lead to precipitations, or barely so. Ammonium can, for example, be added as a bifluoride. At the same time, the pH can be affected by adding ammonia without increasing the sodium and potassium content.

In the process according to the invention, the dissolved contents in the phosphating solution can preferably be as follows:

sulfate: virtually none or 0.005 to 5 g/l and/or chloride: virtually none or 0.020 to 0.5 g/l, particularly sulfate: 0.01 to 4 g/l, particularly preferably 0.02 to 3 g/l and particularly chloride: 0.050 to 0.3 g/l, particularly preferably at least 0.075 g/l or up to 0.15 g/l.

It is generally advantageous to add at least one accelerator to the phosphating solution. In the process according to the invention, the phosphating solution can contain at least one accelerator selected from the group of compounds or ions based on at least one nitrogen-containing compound in the concentration range of 0.01 to 8 g/l, chlorate in the concentration range of 0.01 to 6 g/l, hydroxylamine in the concentration range of 0.01 to 3 g/l and peroxide, including water-soluble organic peroxide, in the concentration range of 0.001 to 0.200 g/l, calculated as $H_2O_2$.

The phosphating solution particularly preferably has at least a certain nitrate content as accelerator, but an addition of at least one other accelerator is advantageous. The contents of the respective nitrogen-containing compounds may advantageously be 0.01 to 2 g/l for m-nitrobenzenesulfonate, 0.001 to 0.400 g/l for nitrite and 0.01 to 3.5 g/l for nitroguanidine. The content based on chlorate is preferably virtually none or in the range of 0.05 to 4 g/l, or particularly preferably in the range of 0.1 to 3 g/l or of 0.15 to 1.8 g/l. The content based on hydroxylamine is preferably virtually none or in the range of 0.05 to 2 g/l, or particularly preferably in the range of 0.2 to 1.5 g/l. The content based on m-nitrobenzenesulfonate is preferably virtually none or in the range of 0.05 to 1.5 g/l, or particularly preferably in the range of 0.15 to 1 g/l. The content based on nitrite is preferably virtually none or in the range of 0.005 to 0.350 g/l, or particularly preferably in the range of 0.010 to 0.300 g/l. The content based on guanidine is preferably virtually none or in the range of 0.1 to 3 g/l, or particularly preferably in the range of 0.3 to 2.5 g/l. The content based on peroxide, including water-soluble organic peroxide, is preferably virtually none or in the range of 0.003 to 0.150 g/l, or particularly preferably in the range of 0.005 to 0.100 g/l. The total content of all accelerators is preferably less than 5 g/l, particularly preferably less than 4 g/l, especially less than 3.5 g/l, less than 3 g/l or less than 2.5 g/l.

In the process according to the invention, the total content of all cations in the phosphating solution can preferably lie within the concentration range of 0.35 to 80 g/l, calculated on a molar basis as Zn, and the total content of all anions, excluding accelerators but including nitrate, can preferably be within the concentration range of 4 to 120 g/l, calculated on a molar basis as $PO_4$. Alternatively, or in addition, at least one accelerator other than those mentioned above can also be used, particularly one based on a nitro compound, such as e.g. based on nitrobenzoate and/or nitrophenol. The phosphating solution preferably does not contain an accelerator based on hydroxylamine.

In the process according to the invention, the content of magnesium in the phosphating solution can preferably be no more than 1 g/l, particularly preferably less than 0.5 g/l, especially preferably no more than 0.15 g/l.

In the process according to the invention, it is preferred that no or almost no precipitation product based on aluminium fluorocomplexes of ammonium, alkali and/or alkaline earth metal is deposited on the metallic surface, below the phosphate film and/or between the zinc, phosphate crystals in the phosphate film on surfaces of aluminium and/or at least one aluminium alloy phosphated in this way—or at least the quantities thereof should be sufficiently restricted that the precipitates do not give rise to paint defects in the subsequent paint film.

In the process according to the invention, it is preferable to work with solutions that are substantially free from ions or compounds and/or their derivatives based on barium, lead, cadmium, chromium, hafnium, cobalt, lithium, molybdenum, niobium, tantalum, vanadium, tungsten, precious metals, such as e.g. silver, bromine, iodine, phosphonic acids, polyhydric alcohols with 8 or more C atoms, carboxylic acids and/or other organic acids, such as gluconic acid, silanes, siloxanes and/or organic polymers, copolymers and homopolymers, such as e.g. resins, and that are optionally also substantially free from colloidal and other particles, Substantially here means, in particular, without the intentional addition of these ions or compounds, so that contents of these substances, if present, are most likely to be brought about in a small amount by impurities, pickling reactions and entrainments. In many cases, it is also preferable for no copper to be added. In the process according to the invention, it is preferred to work under electroless conditions; however, it is possible in principle to use the phosphating solution electrolytically, but in this case, the content of accelerators can be reduced or even omitted.

To determine the free acid, KCl is added to 10 ml of the phosphating solution without dilution for the purpose of shifting dissociation of the complex fluoride until saturation is achieved, and titration is performed with 0.1M NaOH using dimethyl yellow as an indicator until the colour changes from red to yellow. The quantity of 0.1M NaOH consumed in ml gives the value of the free acid (FA-KCl) in points.

To determine the total content of phosphate ions, 10 ml of the phosphating solution are diluted with 200 ml deionised water and titrated with 0.1M NaOH using bromocresol green as indicator until the colour changes from yellow to turquoise. Following this titration, after adding 20 ml of 30% neutral potassium oxalate solution, titration is performed with 0.1M NaOH against phenolphthalein as indicator until the colour changes from blue to purple. The consumption of 0.1M NaOH in ml between the colour change with bromocresol green and the colour change with phenolphthalein corresponds to the total acid according to Fischer (TAF) in points. If this value is multiplied by 0.71, the total content of phosphate ions in $P_2O_5$ is obtained, or multiplied by 0.969 for $PO_4$ (cf. W. Rausch: "Die Phosphatierung von Metallen", Eugen G. Leuze-Verlag 1988, pp. 300 ff.).

The so-called S value is obtained by dividing the value of the free acid determined with KCl by the value of the total acid according to Fischer.

The dilute total acid ($TA_{dilute}$) is the sum of the divalent cations contained together with free and bound phosphoric acids (the latter are phosphates). It is determined by the consumption of 0.1 molar sodium hydroxide solution using the indicator phenolphthalein on 10 ml of phosphating solution diluted with 200 ml of deionised water. This consumption of 0.1 molar NaOH in ml corresponds to the points value of the total acid.

In the process according to the invention, the content of free acid determined with KCl can preferably be in the range of 0.3 to 6 points, the content of dilute total acid preferably in the range of 8 to 70 points and/or the content of total acid according to Fischer preferably in the range of 4 to 50 points. The range of the free acid determined with KCl is preferably 0.4 to 5.5 points, particularly 0.6 to 5 points. The range of the dilute total acid is preferably 12 to 50 points, particularly 18 to 44 points. The range of the total acid according to Fischer is preferably 7 to 42 points, particularly 10 to 30 points. The S value as a ratio of the number of points of the free acid determined with KCl to those of the total acid according to Fischer is preferably in the range of 0.01 to 0.40 points, particularly in the range of 0.03 to 0.035 points, especially in the range of 0.05 to 0.30 points.

In the coating process according to the invention, the pH of the phosphating solution can be in the range of 1 to 4, preferably in the range of 2.2 to 3.6, particularly preferably in the range of 2.8 to 3.3.

In the coating process according to the invention, substrates with a metallic surface predominantly containing aluminium, iron, copper, tin or zinc can be coated with the phosphating solution, with a minimum content of aluminium and/or at least one aluminium alloy always occurring, particularly surfaces of at least one of the materials based on aluminium, iron, copper, steel, zinc and/or alloys with a content of aluminium, iron, copper, magnesium, tin or zinc. In the coating of strips according to the invention, these are generally strips of aluminium and/or at least one aluminium alloy.

In the coating process according to the invention, the phosphating solution can be applied on to the surface of the substrates by flow coating, lance application, roll coating, sprinkling, spraying, brushing, dipping, misting or roller application, it being possible for individual process steps to be combined together—particularly sprinkling, spraying and dipping—and spraying and squeegeeing or sprinkling and squeegeeing can particularly be used on a strip.

A slow-moving strip with an aluminium-containing surface can be coated according to the invention, e.g. even in a no-rinse process. The phosphating solution is preferably applied on to the strip by roll-coating, spraying, sprinkling, dipping and/or squeegeeing.

In the process according to the invention, the phosphate coating can preferably be applied at a temperature in the range of 20 to 70° C., particularly in the range of 32 to 65° C., particularly preferably in the range of 40 to 60° C.

In the coating process according to the invention, the metallic substrates can be coated in a period of up to 20 minutes, strip preferably being coated in a period of 0.1 to 120 seconds and particularly preferably in a period of 0.3 to 60 seconds, and parts preferably being coated in a period of 1 to 12 minutes and particularly preferably in a period of 2 to 8 minutes.

The coating weight of the coating according to the invention is preferably in the range of 0.9 to 9 g/m$^2$, particularly preferably at least 1.2 g/m$^2$, or at least 1.6 g/m$^2$ or no more than 8 g/m$^2$, no more than 7.2 g/m$^2$, no more than 6 g/m$^2$ or no more than 5 g/m$^2$. It is preferred for phosphating to be performed in a so-called "coat-forming" way (cf, Werner Rausch: Die Phosphatierung von Metallen, Saulgau, 1988), because this forms a continuous phosphate film readily visible to the naked eye.

It was surprising that it was possible to develop a simple, reliable, inexpensive phosphating process which, on the one hand, enabled continuous, good phosphate films to be formed with sufficiently high quality, even in terms of corrosion resistance and paint adhesion, in which it was also possible at the same time to avoid the problems with precipitates containing Al—F on aluminium-containing surfaces that have occurred repeatedly up to the present. This process also proved suitable for increased proportions of aluminium-containing surfaces in the mix of the metallic surfaces to be phosphated.

The substrates coated by the process according to the invention can be used in the production of strip and parts, for the production of components or body parts or pre-assembled elements in the automotive or aircraft industry, in the construction industry, in the furniture industry, for the production of equipment and plant, particularly domestic appliances, measuring instruments, control devices, testing devices, structural elements, claddings and small parts; as wire, wire wrap, wire mesh, sheet, cladding, screening, a car body or part of a car body, as part of a vehicle, trailer, motorhome or aircraft, as an electronic or microelectronic component, as a cover, housing, lamp, light, traffic light element, a piece of furniture or a furniture part, part of a domestic appliance, stand, profile, moulded part with complicated geometry, crash barrier, radiator or fence element, bumper, part consisting of or with at least one pipe and/or a profile, window-, door- or bicycle frame or as a small part, such as e.g. a screw, nut, flange, spring or spectacle frame.

EXAMPLES AND COMPARATIVE EXAMPLES

The subject matter of the invention is explained in more detail by means of the following examples:

The examples are based on the substrates and process steps listed below:

The test sheets consisted of a mix of sheets, in a ratio of 1:1:1 in each case, a) of an aluminium alloy AA6016, approx. 1.15 mm thick, ground with abrasive paper 240, b) of a cold-rolled, continuously annealed sheet of unalloyed steel DC04B approx, 0.8 mm thick and c) thin sheet, electrolytically galvanised on both sides, automotive quality, grade DC05, ZE75/75, steel, each approx, 0.85 mm thick. The surface area of each individual sheet, of which a total of at least 3 were used per test, was 400 cm$^2$ (measured over both surfaces).

a) The substrate surfaces were cleaned in a 2% aqueous solution of a mildly alkaline cleaner for 5 minutes at 58 to 60° C. and thoroughly degreased during this process.
b) This was followed by a rinse with tap water for 0.5 minutes at room temperature.
c) The surfaces were then activated by dipping in an activating agent containing titanium phosphate for 0.5 minutes at room temperature.
d) The surfaces were then phosphated for 3 minutes at 55° C. by dipping in the phosphating solution. In some of the examples, a semi-technical plant was used with a 220-liter bath capacity and in the other examples, a pot with a 10-liter bath capacity was used. In each case, rapid stirring and heating were applied.
e) Rinsing was then first performed with tap water followed by a secondary rinse with an aqueous solution containing zirconium fluoride and a final rinse with deionised water.
f) The coated substrates were then dried in a drying oven at 80° C. for 10 minutes. Some of the test sheets were then removed and tested for alkali- and fluoride-containing precipitates. The coating weight was also determined in this state.
g) Finally, the dry test sheets were provided with a cathodic electrodeposition paint and coated with the other coats of a paint structure conventional for bodies in the automotive industry.

The composition of the respective phosphating solution is given in Table 1.

TABLE 1

Composition of the phosphating solutions in g/l and with data for the free acid (FA-KCl), dilute total acid ($TA_{dilute}$) and total acid according to Fischer (TAF) in points, the S value (ratio of FA-KCl:TAF), cryolite deposits on the sheets and the coating weight

| Example Contents in g/l | E 1 | E 2 | E 3 | CE 4 | E 5 | E 6 | CE 7 | CE 8 | E 9 | E 10 | CE 11 | CE 12 | E 13 | E 14 | CE 15 | E 16 | CE 17 | E 18 |
|---|---|---|---|---|---|---|---|---|---|---|---|---|---|---|---|---|---|---|
| Zn | 1.5 | 1.5 | 1.5 | 1.5 | 1.5 | 1.5 | 1.5 | 1.5 | 1.5 | 1.5 | 1.5 | 1.5 | 1.5 | 1.5 | 1.5 | 2.0 | 1.0 | 1.5 |
| Ni | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 |
| Mn | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 |
| Na | 0.1 | 1 | 1.8 | 5 | 0.1 | 1 | 2.5 | 5 | 0.1 | 1 | 3 | 5 | — | — | — | 1.8 | 3 | 1 |
| K | — | — | — | — | — | — | — | — | — | — | — | — | 1 | 2.2 | 5 | — | — | — |
| $NH_4$ | 2 | 1.3 | 0.45 | — | 2.2 | 1.6 | — | 0.2 | 2.4 | 1.5 | 0.3 | 0.3 | 1.5 | 0.8 | — | 0.6 | 0.4 | 1.4 |
| $PO_4$ | 17.4 | 17.4 | 17.4 | 17.4 | 17.4 | 17.4 | 17.4 | 17.4 | 17.4 | 17.4 | 17.4 | 17.4 | 17.4 | 17.4 | 17.4 | 17.4 | 17.4 | 17.4 |
| $NO_3$ | 1 | 1 | 2.5 | 7.8 | 1 | 1 | 2.1 | 7.5 | 1 | 1 | 2 | 7.4 | 1 | 1 | 1.8 | 3.0 | 1 | 1 |
| $SiF_6$ | 1.5 | 1.5 | 1.5 | 1.5 | 1.5 | 1.5 | 1.5 | 1.5 | 1.5 | 1.5 | 1.5 | 1.5 | — | — | — | 1.5 | 1.5 | 1.5 |
| $BF_4$ | — | — | — | — | — | — | — | — | — | — | — | — | 0.5 | 0.5 | 0.5 | — | — | — |
| F free | 0.1 | 0.1 | 0.1 | 0.1 | 0.2 | 0.2 | 0.2 | 0.2 | 0.25 | 0.25 | 0.25 | 0.25 | 0.2 | 0.2 | 0.2 | 0.25 | 0.25 | 0.2 |
| F total | 1.5 | 1.5 | 1.5 | 1.5 | 1.8 | 1.8 | 1.8 | 1.8 | 2.0 | 2.0 | 2.0 | 2.0 | 0.5 | 0.5 | 0.5 | 1.9 | 1.9 | 1.8 |
| Ti or Zr | — | — | — | — | — | — | — | — | — | — | — | — | — | — | — | — | — | Zr 0.005 |
| FA-KCl | 1.8 | 1.8 | 2 | 2.4 | 1.6 | 1.7 | 2.8 | 2.3 | 1.7 | 2.6 | 1.8 | 2.3 | 2.4 | 2.5 | 1.7 | 2.0 | 1.7 | 2.5 |
| $TA_{dilute}$ | 28.5 | 28.5 | 28.8 | 29.2 | 28.3 | 28.4 | 29.6 | 29.1 | 28.4 | 29.4 | 28.6 | 29 | 25.2 | 25.3 | 24.4 | 29.4 | 27.8 | 29.3 |
| TAF | 18.3 | 18.3 | 18.3 | 18.3 | 18.3 | 18.3 | 18.3 | 18.3 | 18.3 | 18.3 | 18.3 | 18.3 | 18.3 | 18.3 | 18.3 | 18.3 | 18.3 | 18.3 |
| S value | 0.1 | 0.1 | 0.11 | 0.13 | 0.09 | 0.09 | 0.15 | 0.13 | 0.09 | 0.14 | 0.1 | 0.13 | 0.13 | 0.14 | 0.09 | 0.11 | 0.09 | 0.14 |
| Cryolite on sheet | no | no | no | yes | no | no | yes | yes | no | no | yes | yes | no | no | yes | no | yes | no |
| Coating | 2.8 | 2.6 | 2.0 | 3.2 | 2.8 | 2.7 | 3.0 | 2.9 | 2.9 | 3.2 | 2.9 | 2.8 | 3.0 | 2.5 | 3.2 | 2.6 | 2.7 | 2.6 |

TABLE 1-continued

Composition of the phosphating solutions in g/l and with data for the free acid (FA-KCl), dilute total acid ($TA_{dilute}$) and total acid according to Fischer (TAF) in points, the S value (ratio of FA-KCl:TAF), cryolite deposits on the sheets and the coating weight

| weight g/m$^2$ | | | | | | | | | | | | | | | |
|---|---|---|---|---|---|---|---|---|---|---|---|---|---|---|---|
| Example Contents in g/l | CE 19 | E 20 | CE 21 | E 22 | CE 23 | E 24 | CE 25 | E 26 | CE 27 | E 28 | CE 29 | CE 30 | E 31 | E 32 | E 33 |
| Zn | 1.5 | 1.5 | 1.5 | 1.5 | 1.5 | 1.5 | 1.5 | 1.5 | 1.5 | 2.0 | 2.0 | 0.7 | 1.5 | 1.5 | 1.5 |
| Ni | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 |
| Mn | 0.8 | 0.8 | 0.8 | 0.8 | 0.8 | 0.8 | 0.8 | 0.8 | 0.8 | 0.8 | 0.8 | 0.8 | 1.6 | 0.8 | 0.8 |
| Na | 3 | 1 | 3 | 1 | 3 | 0.5 | 3 | 0.5 | 0.5 | 1.9 | 3.5 | 3 | 1 | 1 | 1 |
| K | — | — | — | — | — | 0.5 | 0.5 | 0.5 | 4.0 | — | — | — | — | — | — |
| $NH_4$ | — | 1.5 | 0.2 | 2 | 7.2 | 1.6 | 0.2 | 1.3 | 0.2 | 2.3 | — | 3.1 | 1.1 | 1.1 | 1.1 |
| $PO_4$ | 17.4 | 17.4 | 17.4 | 17.4 | 17.4 | 17.4 | 17.4 | 17.4 | 17.4 | 26.8 | 10.7 | 26.8 | 17.4 | 17.4 | 17.4 |
| $NO_3$ | 1 | 1 | 2.1 | 1 | 26.1 | 1 | 2.9 | 1 | 2.7 | 1.0 | 6.9 | 4 | 1 | 1 | 1 |
| $SiF_6$ | 1.5 | 1.5 | 1.5 | 1.5 | 1.5 | 1.5 | 1.5 | — | — | 1.5 | 1.5 | 1.5 | 1.5 | 1.5 | 1.5 |
| $BF_4$ | — | — | — | — | — | — | — | 0.2 | 0.2 | — | — | — | — | — | — |
| F free | 0.2 | 0.2 | 0.2 | 0.2 | 0.2 | 0.2 | 0.2 | 0.2 | 0.2 | 0.25 | 0.25 | 0.25 | 0.1 | 0.1 | 0.1 |
| F total | 1.8 | 1.8 | 1.8 | 1.8 | 1.8 | 1.8 | 1.8 | 0.7 | 0.7 | 1.9 | 1.9 | 1.9 | 1.5 | 1.5 | 1.5 |
| Ti or Zr | Zr 0.005 | Ti 0.005 | Ti 0.005 | — | — | — | — | — | — | — | — | — | — | Zr 0.020 | Ti 0.020 |
| FA-KCl | 1.5 | 2.0 | 2.3 | 0.8 | 2.1 | 2.3 | 2.3 | 2.2 | 2.1 | 1.9 | 0.9 | 2.4 | 2.2 | 2.8 | 2.8 |
| $TA_{dilute}$ | 28.3 | 28.8 | 29.1 | 27.6 | 28.9 | 29.1 | 29.1 | 24.8 | 24.7 | 39.2 | 21.1 | 38.1 | 29.2 | 29.5 | 29.5 |
| TAF | 18.3 | 18.3 | 18.3 | 18.3 | 18.3 | 18.3 | 18.3 | 18.3 | 18.3 | 28.2 | 11.2 | 28.2 | 18.3 | 18.3 | 18.3 |
| S value | 0.08 | 0.11 | 0.13 | 0.05 | 0.11 | 0.13 | 0.13 | 0.12 | 0.11 | 0.07 | 0.08 | 0.09 | 0.12 | 0.15 | 0.15 |
| Cryolite on sheet | yes | no | yes | no | yes | no | yes | no | yes | no | yes | yes | No | no | no |
| Coating weight g/m$^2$ | 3.3 | 2.9 | 2.7 | 4.0 | 2.9 | 3.1 | 2.9 | 3.2 | 3.0 | 2.2 | 4.2 | 2.3 | 3.0 | 2.4 | 2.5 |

No aluminium, calcium, magnesium or iron was deliberately added. Contents of such substances in the phosphating solution arose because of trace contaminants in the water, the additives and the sheet metal surfaces. For dissolved aluminium in the phosphating solution, depending on the sample, there was a content in the range of a few mg/l. A small content of dissolved iron(II) ions in the phosphating solution arose because of the composition of the phosphating solution, but a significant iron content could only have been established with a higher throughput of sheets in the phosphating solution. In addition, nitroguanidine was added to the phosphating solution in each case as an accelerator with a content in the range of 0.6 to 0.8 g/l. Fluorides or phosphates of Al, Fe, Zn and possibly other cations are found in the so-called "sludge". These precipitation products are scarcely deposited on the surfaces of the sheets, however. The data for "cryolite on sheet" refers to deposits on phosphated metal sheets with predominantly cube-like crystals, the morphology of which could be clearly seen using a scanning electron microscope and the composition of which was established by qualitative determination of the Na and/or K contents by EDX. In addition, F contents could also be detected using a microprobe. The precipitation products were visible as deposits beginning to form on surfaces of the aluminium alloy.

Despite marked variation of the chemical composition of the phosphating solution, an adequate quality of the coating was maintained within broad ranges.

The phosphate films in the examples according to the invention were sufficiently finely crystalline and sufficiently continuous. Their corrosion resistance and adhesive strength corresponded to typical quality standards of similar zinc phosphate films. All the sheets according to the invention, unlike the sheets in the comparative examples, displayed no deposit of cryolite or chemically related phases. In the sheets in the comparative examples, because of these deposits on the phosphate film or between the zinc phosphate crystals in the phosphate film, there was a different surface finish compared with the sheets coated according to the invention. The surface finish of the coated substrates in the comparative examples can lead to paint defects as a result of painting, such as unacceptable rough paint surfaces or bubbles in the paint film and thus, necessarily, to subsequent work, e.g. by sanding the painted surface. With the process according to the invention, it was not necessary to use a separate area in the phosphating solution vessel for the precipitation, and it was even unnecessary to use a separate, additional precipitating vessel.

Some of the sheets of AA6016 prepared in this way were subjected to an outdoor weathering test according to VDA standard 621-414. Predominantly those sheets were selected which are chemically on the border between precipitation and non-precipitation of the cryolite. For this purpose, these sheets were provided with the following paint structure for the outdoor weathering test: BASF Cathoguard® 400 and three-coat paint structure as at DaimlerChrysler in Sindelfingen. The overall four-coat paint structure had an average thickness of 110 μm. Table 2 gives the results of the corrosion test after 6 and 9 months' outdoor weathering in Frankfurt am Main.

TABLE 2

Results of the outdoor weathering test according to VDA standard 621-414 on overpainted sheets of AA6016 in correlation with the Na and $F_{free}$ content

| Examples/ | Na | K | $F_{free}$ | Creepage in mm acc. to VDA standard 621-414 | |
|---|---|---|---|---|---|
| comparative examples | content g/l | content g/l | content g/l | after 6 months | after 9 months |
| E 1 | 0.1 | 0 | 0.1 | 0 | 0 |
| E 2 | 1.0 | 0 | 0.1 | 0 | 0 |

TABLE 2-continued

Results of the outdoor weathering test according to VDA standard 621-414 on overpainted sheets of AA6016 in correlation with the Na and $F_{free}$ content

| Examples/ comparative examples | Na content g/l | K content g/l | $F_{free}$ content g/l | Creepage in mm acc. to VDA standard 621-414 after 6 months | after 9 months |
|---|---|---|---|---|---|
| E 3 | 1.8 | 0 | 0.1 | 0 | 0 |
| CE 4 | 5.0 | 0 | 0.1 | 1.5 | 2.5 |
| E 9 | 0.1 | 0 | 0.1 | 0 | 0 |
| E 10 | 1.0 | 0 | 1.0 | 0 | 0 |
| CE 11 | 3.0 | 0 | 3.0 | 2.0 | 3.0 |
| CE 12 | 5.0 | 0 | 5.0 | 2.5 | 3.5 |
| E 16 | 1.8 | 0 | 0.25 | 0 | 0 |
| CE 17 | 3.0 | 0 | 0.25 | 2.5 | 3.0 |
| CE 27 | 0.5 | 4.0 | 0.2 | 2.5 | 3.5 |
| E 28 | 1.9 | 0 | 0.25 | 0 | 0 |
| CE 29 | 3.5 | 0 | 0.25 | 1.5 | 2.5 |
| CE 30 | 3.0 | 0 | 0.25 | 2.5 | 3.5 |

The delineation between the examples and the comparative examples was guided by the composition of the main claim. However, this allocation was also strictly in line with the precipitation or non-precipitation of cryolite. All sheets on which no cryolite precipitation occurred displayed excellent corrosion resistance. Thus, it has been demonstrated that with low and with high contents of sodium or the sum of sodium and potassium and/or of $F_{free}$, almost to the border of cryolite precipitation, excellent corrosion protection results are achieved, provided that no cryolite is precipitated. As cryolite is precipitated, the corrosion resistance also deteriorates significantly and becomes even worse as the cryolite precipitation increases.

The invention claimed is:

1. A process comprising:

applying an aqueous, acidic phosphating solution comprising dissolved contents to a metallic surface, said metallic surface comprising at least 5% by weight of at least one of aluminum or an aluminum alloy, wherein the dissolved contents in the phosphating solution comprise:

having a combined sodium and potassium content in the range of 0.3 to 1.8 g/L as sodium, the potassium content being converted to sodium on a molar basis;

zinc in a concentration range of 0.2 to 4 g/L;

phosphate in a concentration range of 4 to 65 g/L, calculated as $PO_4$;

free fluoride in a concentration range of 0.03 to 0.5 g/L;

total fluoride in the concentration range of 0.1 to 5 g/L;

silver in the concentration range of 0.001 to 0.080 g/L;

wherein a zinc-containing phosphate film is deposited on the metallic surface and has a coating weight in the range of 0.5 to 10 g/m$^2$, whereby free acid in the phosphating solution is maintained in the range of 1.6 to 2.8 points as measured by FA-KCl, wherein the process is conducted without a precipitation tank, whereby precipitation products from an Al—F complex are scarcely deposited on the metallic surface so that there is no significant deterioration of corrosion resistance by the precipitation products, wherein the content based on hydroxylamine is virtually none, and wherein no copper is added.

2. The process according to claim 1, wherein the content of dissolved aluminum in the phosphating solution are in the concentration range of 0.002 to 1 g/L.

3. The process according to claim 1, wherein the phosphating solution comprises at least one of a silicon complex fluoride and a boron complex fluoride, wherein the total content of the boron and the silicon complex fluoride in the phosphating solution is 0.01 to 4 g/L.

4. The process according to claim 1, wherein a content of complex bound fluoride in the phosphating solution is from 0.01 to 4 g/L, calculated on a molar basis as $SiF_6$.

5. The process according to claim 1, wherein the contents dissolved in the phosphating solution are as follows:

sodium: in the concentration range of 0.050 to 1.8 g/L, potassium: virtually none or in the concentration range of 0.030 to 1.5 g/L, sodium and potassium: in the concentration range of 0.025 to 1.5 g/L as sodium, potassium being converted to sodium on a molar basis, silicon complex fluoride: in the concentration range of 0.01 to 4 g/L and/or boron complex fluoride: in the concentration range of 0.01 to 4 g/L, calculated as $SiF_6$ and $BF_4$ respectively.

6. The process according to claim 1, wherein at least one of the contents in the phosphating solution are present as follows:

sodium: virtually none or in the concentration range of 0.060 to 1.8 g/L;

potassium: in the concentration range of 0.035 to 1.4 g/L;

sodium and potassium: in the concentration range of 0.05 to 1.8 g/L as sodium, potassium being converted to sodium on a molar basis;

silicon complex fluoride: in the concentration range of 0.02 to 1 g/L or boron complex fluoride: in the concentration range of 0.02 to 3 g/L, calculated as $SiF_6$ and $BF_4$ respectively.

7. The process according to claim 1, wherein the dissolved contents comprise at least one of nickel: virtually none or in the range of 0.001 to 3 g/L, or manganese: virtually none or in the range of 0.002 to 5 g/L.

8. The process according to claim 1, wherein the dissolved contents comprise at least one of dissolved iron$^{2+}$ ions: virtually none or in the concentration range of 0.005 to 3 g/L or complexed iron$^{3+}$ ions: virtually none or in the concentration range of 0.005 to 1 g/L.

9. The process according to claim 1, wherein the dissolved contents comprises at least one of:

titanium: virtually none or in the concentration range of 0.001 to 0.200 g/L or zirconium: virtually none or in the concentration range of 0.001 to 0.200 g/L.

10. The process according to claim 1, wherein, the dissolved contents comprise at least one of:

ammonium: virtually none or in the concentration range of 0.01 to 50 g/L or nitrate: virtually none or in the concentration range of 0.01 to 30 g/L.

11. The process according to claim 1, wherein the dissolved contents comprise at least one of:

sulfate: virtually none or in the concentration range of 0.005 to 5 g/L or chloride: virtually none or in the concentration range of 0.020 to 0.5 g/L.

12. The process according to claim 1, wherein the phosphating solution comprises at least one accelerator selected from the group consisting of a compounds or ions based on nitrogen-containing compounds in the concentration range of 0.01 to 8 g/L;

chlorate in the concentration range of 0.01 to 6 g/L;

and peroxide, including water-soluble organic peroxide, in the concentration range of 0.001 to 0.200 g/L, calculated as $H_2O_2$.

13. The process according to claim 1, wherein the content of magnesium in the phosphating solution is not more than 1 g/L.

14. The process according to claim 13, wherein the contents of the magnesium is not more than 0.15 g/L.

15. The process according to claim 1, wherein the phosphating solution has a pH in the range of 2 to 4.

16. The process according to claim 1, wherein the content of free acid determined with KCl is in the range of 1.6 to 2.8 points, the content of dilute total acid is in the range of 25.2 to 29.6 points or the content of total acid according to Fischer is 18.3.

17. The process according to claim 1, wherein the phosphating solution is applied at a temperature of from 20 to 70° C.

18. The process of claim 1, wherein the metallic surface is a body part for an automobile or an aircraft, a sheet, a wire mesh, or a small plant.

19. The process of claim 1, wherein the Al—F complex is cryolite.

20. A process comprising:

applying an aqueous, acidic phosphating solution comprising dissolved contents to a metallic surface in the absence of a precipitated tank, said metallic surface comprising at least 5% by weight of at least one of aluminum or an aluminum alloy, wherein the dissolved contents in the phosphating solution comprise:

virtually no sodium or a concentration of sodium in the range of at least 0.04 g/L, virtually no potassium or a concentration of potassium in the range of at least 0.025 g/L, wherein the concentrations of sodium and potassium together is in the range of 0.3 to 1.8 g/L as sodium, the potassium content being converted to sodium on a molar basis;

zinc in a concentration range of 0.2 to 4 g/L;

phosphate in a concentration range of 4 to 65 g/L, calculated as $PO_4$;

free fluoride in a concentration range of 0.03 to 0.5 g/L;

total fluoride in the concentration range of 0.1 to 5 g/L;

silver in the concentration range of 0.001 to 0.080 g/L;

wherein a zinc-containing phosphate film is deposited on the metallic surface and has a coating weight in the range of 0.5 to 10 g/m$^2$, wherein the range of free fluoride is from 0.1 to 0.25 points, whereby precipitation products from an Al—F complex are scarcely deposited on the metallic surface so that there is no significant deterioration of corrosion resistance by the precipitation products, wherein the content based on hydroxylamine is virtually none, and wherein no copper is added.

21. The process according to claim 20, wherein a content of complex bound fluoride in the phosphating solution is from 0.01 to 4 g/L, calculated on a molar basis as $SiF_6$.

22. The process of claim 20, wherein the Al—F complex is cryolite.

23. A process comprising:

applying an aqueous, acidic phosphating solution comprising dissolved contents to a metallic surface, said metallic surface comprising at least 5% by weight of at least one of aluminum or an aluminum alloy, wherein the dissolved contents in the phosphating solution consist essentially of:

having a combined sodium and potassium content in the range of 0.3 to 1.8 g/L as sodium, the potassium content being converted to sodium on a molar basis;

zinc in a concentration range of 0.2 to 4 g/L;

phosphate in a concentration range of 4 to 65 g/L, calculated as $PO_4$;

free fluoride in a concentration range of 0.03 to 0.5 g/L;

total fluoride in the concentration range of 0.1 to 5 g/L;

silver in the concentration range of 0.001 to 0.080 g/L;

wherein a zinc-containing phosphate film is deposited on the metallic surface and has a coating weight in the range of 0.5 to 10 g/m$^2$, whereby free acid in the phosphating solution is maintained in the range of 1.6 to 2.8 points as measured by FA-KCl wherein the process is conducted without a precipitation tank, whereby precipitation products from an Al—F complex are scarcely deposited on the metallic surface so that there is no significant deterioration of corrosion resistance by the precipitation products, wherein the content based on hydroxylamine is virtually none, and wherein no copper is added.

24. The process of claim 21, wherein the Al—F complex is cryolite.

* * * * *